US005294017A

United States Patent [19]

Li

[11] Patent Number: 5,294,017

[45] Date of Patent: Mar. 15, 1994

[54] RECYCLE AND REFUSE CONTAINER WITH CONTINUOUS SUPPLY OF BAGS

[76] Inventor: Kuo - Chuan Li, No. 8, Lane 421, Chung Cheng Rd. Sec. 1, San Hsia Chen, Taipei Hsien, Taiwan

[21] Appl. No.: 87,418

[22] Filed: Jul. 8, 1993

[51] Int. Cl.[5] ..... B65F 1/06

[52] U.S. Cl. ..... 220/407; 220/571; 220/909; 220/532; 220/404

[58] Field of Search ..... 220/407, 571, 501, 909, 220/908, 532, 533, 404, 23.83, 23.86, 529, 630, 636

[56] References Cited

U.S. PATENT DOCUMENTS

| | | | |
|---|---|---|---|
| 3,800,503 | 4/1974 | Maki | 220/407 |
| 4,798,363 | 1/1989 | Cortesi | 220/407 |
| 5,031,793 | 7/1991 | Chen et al. | 220/407 |
| 5,072,852 | 12/1991 | Smith et al. | 220/909 |
| 5,076,462 | 12/1991 | Perrone | 220/909 |
| 5,078,297 | 1/1992 | Howard et al. | 220/532 |
| 5,115,935 | 5/1992 | Lemongelli | 220/407 |
| 5,135,787 | 8/1992 | Bair | 220/501 |
| 5,174,468 | 12/1992 | Holderman | 220/571 |
| 5,183,157 | 2/1993 | Darden | 220/407 |

*Primary Examiner*—Allan N. Shoap
*Assistant Examiner*—S. Castellano
*Attorney, Agent, or Firm*—Bacon & Thomas

[57] ABSTRACT

A recycle and trash container with continuous supply of bags comprises a refuse container, trash bag housings and a base. The trash bag housing can hold the trash bags in a roll and is placed inside the base. Said refuse container can be placed on top of the base. In the center of the refuse container there are two slots which are designed for the insertion of two dividing plates, thus dividing the refuse container into two containers which can hold different types of trash. Each of the divided container has a reverse V-shaped projecting board on its bottom. At the top of each of the projecting boards is an elongated gaps from which the trash bags can be pulled through and hung on the container. When the refuse container is filled up, the trash bag can be pulled up and removed. An empty trash bag will also come through the elongated gap and may be placed on the refuse container for use.

3 Claims, 4 Drawing Sheets

RECYCLE AND REFUSE CONTAINER WITH CONTINUOUS SUPPLY OF BAGS

BACKGROUND OF THE INVENTION

1. Field of the Invention

The present invention relates to a refuse container which can be divided into a recycle container and a trash container. More specifically, the present invention relates to a recycle and trash container with continuous supply of trash bags.

2. Description of the Prior Art

People in the modern society are paying more attention to the concept of environmental protection. We all realize that it is important to separate the trash for recycling and disposing. Placing a trash bag on the refuse container for use is done manually and is placed one at a time. This method is inconvenient. In addition, most of the trash bags come in a roll and the trash bags are normally placed away from the refuse container. This makes it more inconvenient to place a trash bag on a refuse container for use. Moreover, the trash bags may have a crack and the unsanitary liquid may leak out to the bottom of the refuse container, making the refuse container hard to clean.

SUMMARY OF THE INVENTION

In accordance with our invention, we overcome the above disadvantages and inconveniences by providing a refuse container which is convenient to use, easy to clean and its trash bag supply is continuous. Such refuse container uses a trash bag housing to hold a roll of trash bag, which can be pulled out from the bottom part of the container and placed on it for use. When a trash bag is filed up, it can be pulled up and another empty trash bag will be pulled up for use. Moreover, the unsanitary discharge from a leaky trash bag can be absorbed by a sponge which is placed inside the base. The sponge is replaceable so as to make the cleaning of the refuse container easier. Also, the trash bag housing is placed inside the base. In addition, this refuse container has two dividing plates which are removable to give more room for the cleaning of the refuse container.

The main object according to the present invention is to provide a recycle and trash container in which the trash bag supply is continuous so that the hanging of the trash bag for use is convenient.

Another object according to the present invention is to provide a recycle and trash container in which the bottom part has an absorbing element so that the refuse container is easier to clean.

A further object according to the present invention is to provide a recycle and trash container which can hold classified trash by using dividing plates. Such dividing plates are removable so as to make the cleaning of the refuse container more convenient.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
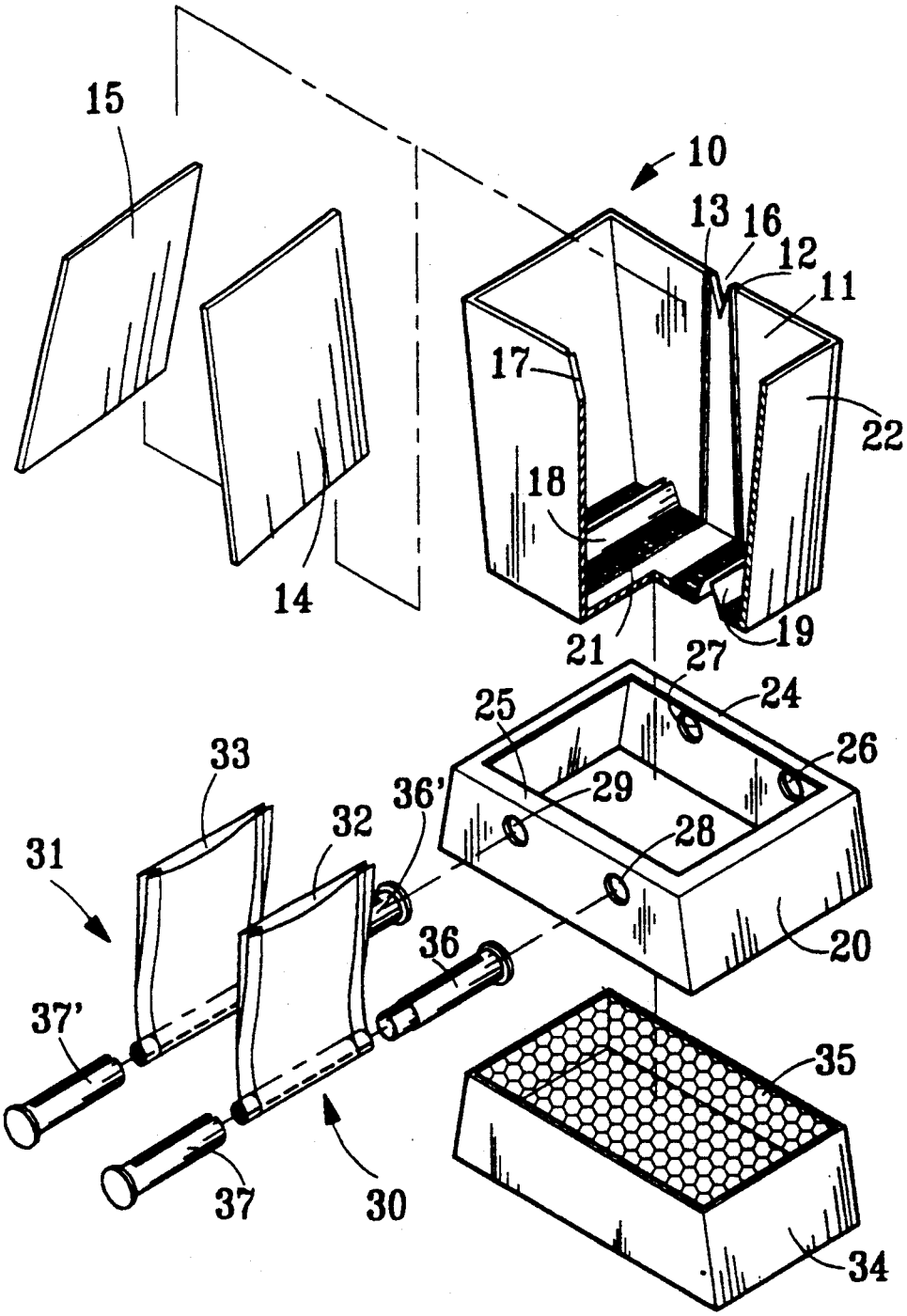
FIG. 1 is a perspective fragmented view of the recycle and trash container according to the present invention.

Referring to FIG. 1, the recycle and trash container 10 according to the present invention consists of a refuse container 11, a base 20 and trash bag housings 30 and 31. In the interior of the refuse container 11 there are two slots 12 and 13 which are centrally located. The slots 12 and 13 are designed for the insertion of two removable dividing plates 14 and 15, dividing the refuse container 11 into two trash bins. In between the slots 12 and 13 on the top edge of the refuse container 11 is a notch 16 and a corresponding notch 17 on the opposite side. The notches are designed for the convenience of hanging the trash bags after the refuse container 11 is divided into two trash cans by the dividing plates 14 and 15. On the bottom of the refuse container 11 is reverse V-shaped projecting boards 18 and 19 separately located in each trash can. At the tip of the projecting boards 18 and 19 are appropriate gaps from which the trash bags can be pulled through. The bottom of the refuse container 11 is a net 21 from which the waste leakage from the trash bag can be discharged. The base 20 is of hollow structure for placing the refuse container 11. The exterior surfaces 22 and 23 of the refuse container is slanted so that it is better support by the base 20. The surfaces on two sides 24 and 25 of the base 20 have two pairs of corresponding holes 26, 27, 28 and 29 through which the trash bag housings 30 and 31 can be inserted. Roller type trash bags 32 and 33 are attached to the trash bag housings 30 and 31 so that the trash bags 32 and 33 can be pulled up and installed through the gap on the top of the reverse V-shaped projecting boards 18 and 19. The hollow area of the base 20 forms a water absorbing chamber 34 which has a replaceable sponge 35. The leakage from the trash bag through the net 21 can therefore be absorbed by the sponge 35.

Figure 2:
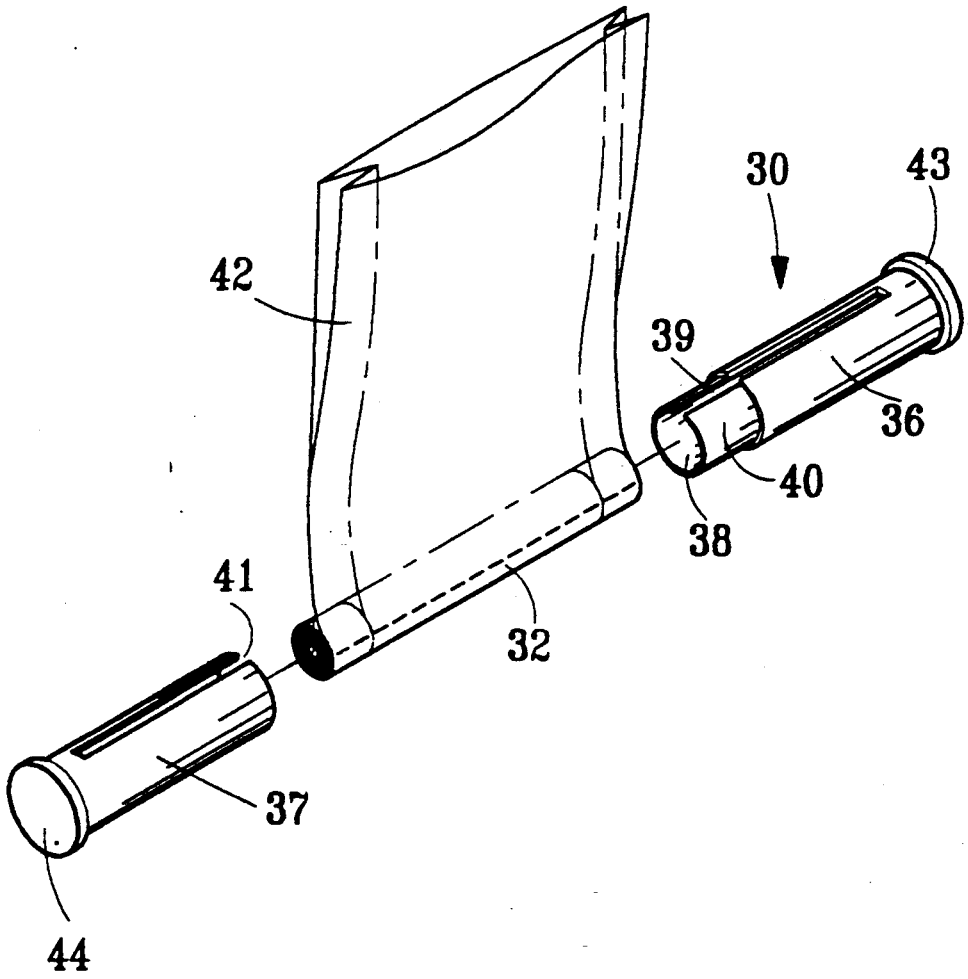
FIG. 2 is a perspective fragmented view showing the roller type trash bags are being placed into the trash bag housing according to the present invention.

Referring to FIG. 2, which shows the roller type trash bags are being placed into the trash bag housing. Said trash bag housing 30 consists of a bag storage tube 36 and a cover tube 37. Inside the bag storage tube 36 is a hollow circular body 38 which is used to hold the roller type trash bags 32. An empty trash bag 42 may be pulled up from an elongated gap 39 of the bag storage tube 38, then the cover tube 37 is inserted into the jutted portion 40 of the bag storage tube 36. The cover tube 37 also has an elongated gap 41 for it to be inserted into the bag storage tube 36 and form the trash bag housing 30. Thus, the roller type trash bags 32 are inserted into the trash bag housing 30 and they can be rolled up as needed. This way the empty trash bags can be pulled out continuously. In addition, the end section of the bag storage tube 36 has a flange 43 and the end section of the cover tube 37 also has a flange 44. As shown in FIG. 1, when the trash bag housing 30 is to be installed into the two pairs of corresponding holes 26, 27, 28 and 29 of the base 20, the roller type trash bags 32 and 33 are first placed inside the storage tubes 36 and 36'. The storage tubes 36 and 36, with the trash bags are inserted into the holes 26 and 27. The cover tubes 37 and 37, are then inserted through the other holes 28 and 29. The storage tubes and the cover tubes are then secured tightly.

Figure 3:
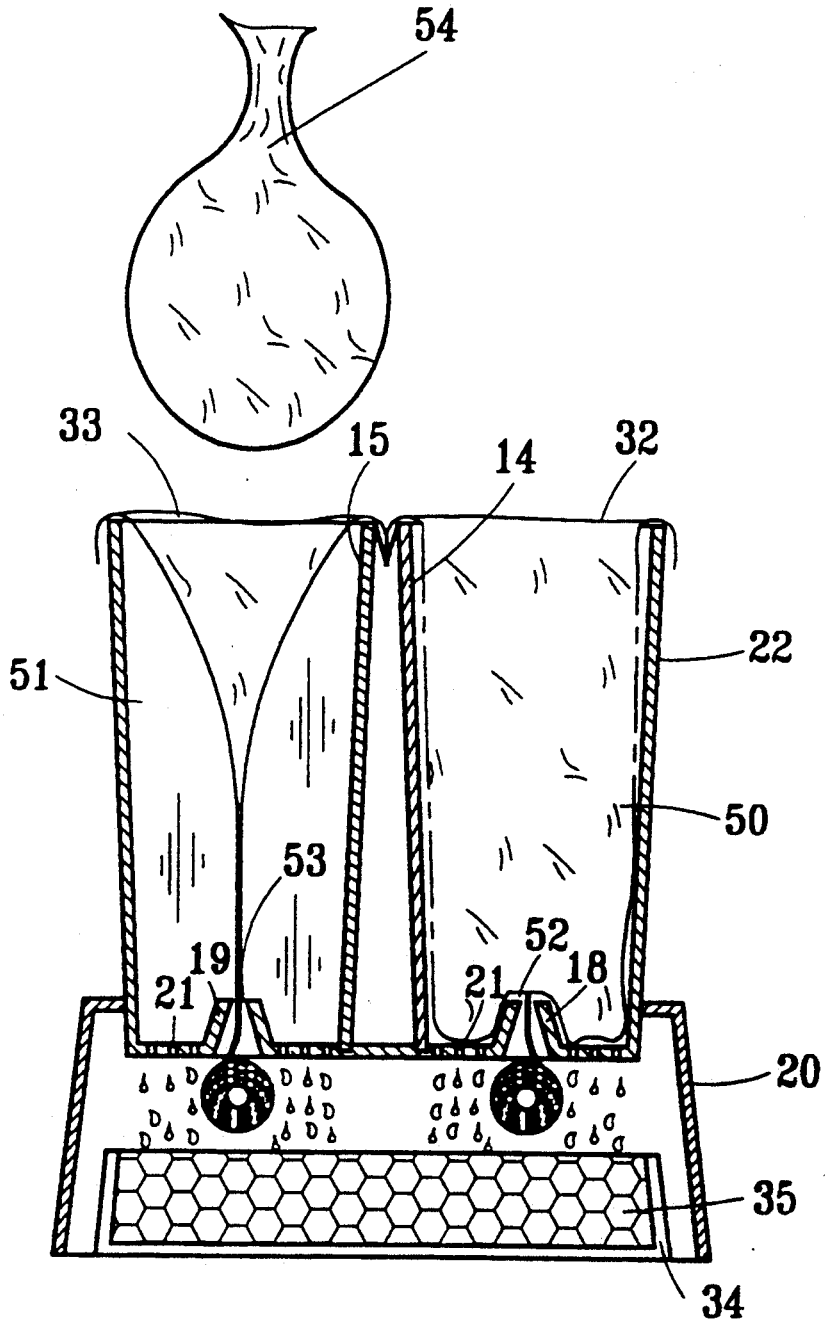
FIG. 3 is a cross-sectional view showing an embodiment of the recycle and trash container according to the present invention.

Referring to FIG. 3, the container 22 is divided by dividing plates 14 and 15 into two trash cans 50 and 51 for the purpose of separating the trash. Hence, the trash can 50 can be used to hold the combustible trash while the trash can 51 may be used to hold the non-combustible trash. The bottom part of both of the trash cans have the reverse V-shaped projecting boards 18 and 19, which have appropriate gaps 52 and 53 at their top respectively. Therefore, the trash bags 32 and 33 can be pulled out from the gaps 52 and 53 respectively. When the trash bag 54 is filled up with trash, it can be pulled out and an empty trash bag will also come out. This empty trash bag can be placed in the trash can so that the trash bags will not run out. In addition, the net 21 underneath the trash cans 50 and 51 is used to screen and discharge the dirty liquid from a leaky trash bag. The discharge from the net 21 are then absorbed by a replaceable sponge 35 in the absorbing chamber 34. This prevents the trash cans from getting messy and the hard-to-breath odor.

Figure 4:
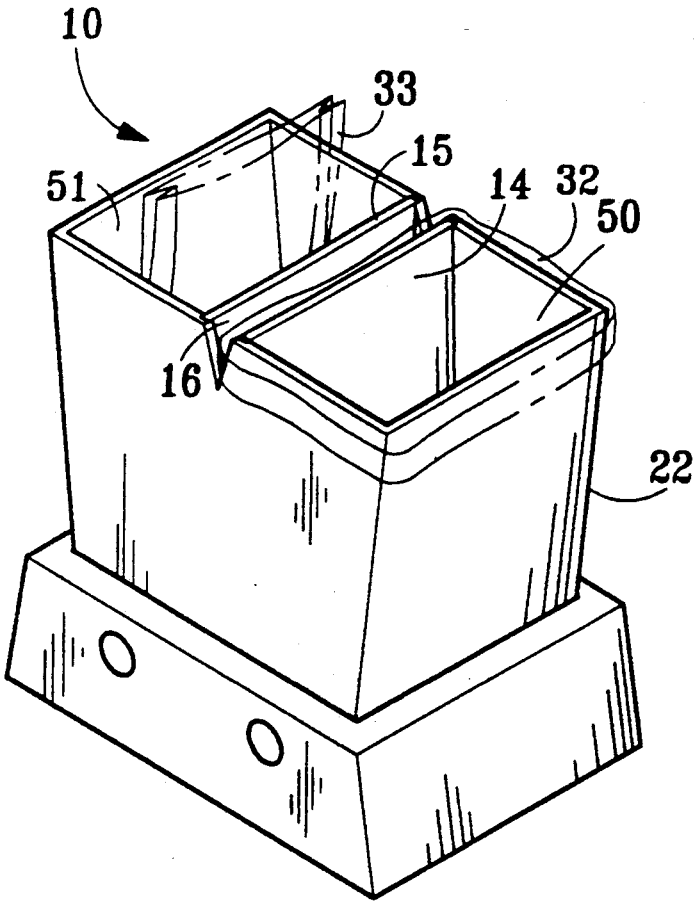
FIG. 4 is a perspective view of the recycle and trash container according to the present invention.

Referring to FIG. 4, which shows a perspective view of the refuse container with recycle-trash bins and never-out trash bags according to the present invention. In use, the trash bags 32 and 33 are placed into the trash can 50 and the recycle can 51 along the edges at the top. The refuse container 22 is separated into a trash can 50 and a recycle can 51 by dividing plates 14 and 15, between which is a reverse V-shaped notch 16 for the convenience of placing the trash bags 32 and 33.

In addition, the refuse container 22 which is divided by dividing plates 14 and 15 into the trash can 50 and the recycle can 51 can have multiple units to meet the demand of the markets.

The foregoing description of the preferred embodiment of the refuse container according to the present invention has been presented for the purpose of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A recycle and refuse container with continuous supply of trash bags comprises a refuse container, trash bag retainers and a base wherein:

said refuse container has two slots which are centrally located in its interior, said slots are designed for the insertion of two removable dividing plates which divide said refuse container into a recycle compartment and a trash compartment, in between the slots on the top edge of the refuse container is a notch which is designed for the convenience of hanging the trash bags, on the bottom of the refuse container are pairs of projecting boards, each pair located in the recycle compartment and the trash compartment respectively, and the projecting boards of each pair are angled inwardly towards each other at upper tips of the projecting boards and an elongated gap extending between the tips from which the trash bags are pulled through, the bottom of the refuse container is a surface having a net from which waste leakage from the trash bags are discharged, the refuse container are placed on top of said base which is of hollow structure, the hollow structure of said base forms a water absorbing chamber which has a sponge for absorbing the waste leakage, opposed sides of the base have two pairs of holes each through which the trash bag retainers are inserted, trash bags in a roll are attached to the trash bag housings so that they can be pulled up through the gap at the tips of the projecting boards and hung on the top edge of the refuse container.

2. The recycle and refuse container with, continuous supply of bags as recited in claim 1 wherein one of said trash retainers comprises a bag storage tube and a cover tube, inside the bag storage tube is a hollow circular body which is used to hold the trash bags in a roll, when these trash bags are placed in the bag storage tube, the cover tube is used to cover them up, forming a complete trash bag housing, this trash bag housing has an elongated gap from which an unused trash bag from the roll is pulled through.

3. The recycle and refuse container with continuous supply of bags as recited in claim 1 wherein said refuse container is divided by said dividing plates into the recycle compartment and the trash compartment, this container is installed in multiple units.

* * * * *